US005255418A

United States Patent [19]

Chen

[11] Patent Number: 5,255,418

[45] Date of Patent: Oct. 26, 1993

[54] AUTOMATICALLY LOCKING SLIDER FOR CONCEALED ZIPPER

[76] Inventor: Shih-Chung Chen, No. 55, Ming Te Road, Te Yin Tsun, Wu-Guu Shiang, Taipei Hsien, Taiwan

[21] Appl. No.: 974,085

[22] Filed: Nov. 10, 1992

[51] Int. Cl.[5] ..... A44B 19/00

[52] U.S. Cl. ..... 24/424; 24/419; 24/421

[58] Field of Search ..... 24/424, 421, 420, 419, 24/418, 429, 422

[56] References Cited

U.S. PATENT DOCUMENTS

| | | | |
|---|---|---|---|
| 2,274,723 | 3/1942 | Morin | 24/424 |
| 2,280,968 | 4/1942 | Newhall | 24/424 |
| 2,487,386 | 11/1949 | Scheuermann | 24/424 |
| 3,924,306 | 12/1975 | Oda | 24/424 |
| 4,287,646 | 9/1981 | Kanbaka | 24/424 |
| 4,829,638 | 5/1989 | Ishii | 24/421 |
| 4,982,479 | 1/1991 | Oda | 24/424 |

FOREIGN PATENT DOCUMENTS

| | | | |
|---|---|---|---|
| 0123699 | 1/1949 | Sweden | 24/421 |

*Primary Examiner*—Victor N. Sakran
*Attorney, Agent, or Firm*—Pro-Techtor International

[57] ABSTRACT

An automatically locking slider for concealed zipper, which comprises a slider body formed with a substantially Y-shaped guide channel for the fastener elements, separator being fixedly mounted on the slider body in a central position at the front end thereof, the member separator having a groove for receiving a resilient locking member which is coupled with a pull tab, whereby the resilient locking member can in response to the pulling force of the pull tab move back and forth between a normally automatically locking position and an unlocking position when the slider body is pulled.

4 Claims, 4 Drawing Sheets

AUTOMATICALLY LOCKING SLIDER FOR CONCEALED ZIPPER

BACKGROUND OF THE INVENTION

The present invention relates to an automatically locking slider for concealed zipper, and more particularly to an improved locking means of slider for concealed zipper.

As well know in the art, the conventional slider structure of concealed zipper includes a slider body formed with a substantially Y-shaped guide channel, and a separator mounted on the slider body in a central position thereof. The separator is pivotally coupled to a locking plate via a horizontally disposed an insert pin through the pin hole walls, whereby the locking plate can move like a lever between a locking position and an unlocking position about the horizontal insert pin by means of the elastic force of a spring which is provided under the locking plate. In this manner, the insert pin must go through at least three pin holes of the separator and the locking plate. This do make the assembly and manufacturing procedure of the zipper and their tooling making much complicated and inconvenient. Moreover, when pulling the slider body, the suspending fluff produced from the cloth and the dust in the air are quite likely to enter and accumulate in the clearance between the insert pin and the pin hole walls. This often prevents the locking plate from smoothly rotating and thus prevents the slider body from being smoothly pulled.

SUMMARY OF THE INVENTION

It is therefore a primary object of the instant invention to provide an automatically locking slider without insert pin for concealed zipper, wherein the structure of the slider is simpler and the assembly and manufacturing procedure as well as the tooling making thereof are faster and easier with the cost lowered.

It is another object of the instant invention to provide the above slider wherein the problem of unsmoothness in pulling the slider caused by the accumulation of the fluff and dust in the clearance between the insert pin and pin hole walls can be completely solved. As a result, the instant slider can be steadily and smoothly slided along the row of the fastener elements.

In the best mode of the instant invention, the above slider can pivotally move back and forth between an automatically locking position and an unlocking position via the elasticity of a resilient locking member itself without using the spring of the conventional slider for providing the elastical force. Therefore, the structure of the instant slider is simplified and the assembly and manufacturing procedure thereof are faster and easier.

According to the above objects, one preferred embodiment of the present invention includes a slider body formed with a substantially Y-shaped guide channel, and separator fixedly mounted on the slider body in a central position at the front end thereof. The separator has a groove for receiving a resilient locking member which is coupled with a pull tab, whereby the resilient locking member can in response to the pulling force of the pull tab move back and forth between a normally automatically locking position and an unlocking position when the slider body is pulled.

The above and other objects features and advantages, will be further understood by the following detailed description and drawings in which:

DETAILED DESCRIPTION OF THE PREFERRED EMBODIMENTS

For facilitating the description, the same element of the respective embodiments is denoted by the same reference numberal, while the corresponding element of the respective embodiments is denoted by the same reference numberal and an English alphabet following the reference numberal.

Figure 1:
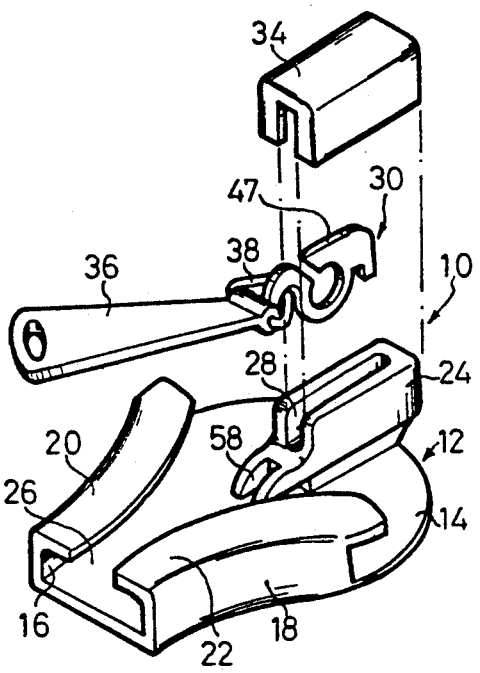
FIG. 1 is a perspective exploded view of the first embodiment of the slider of this invention.

Please refer to FIG. 1. The first embodiment of the present invention includes a slider body 12 having a bottom plate 14, a pair of lateral flanges 16 and 18 formed along parts of respective margined edges of the bottom plate, a pair of lips 20 and 22 extending horizontally inwardly from the tops of the flanges 16 and 18; and separator 24 is fixedly mounted on the bottom plate 14 in a central position at the front end thereof, a substantially Y-shaped guide channel 26 is defined by the slider body 12 and the separator 24 for guiding therethrough the rows of fastener elements (not shown) in the act of coupling or uncoupling the zipper in the usual manner. The separator 24 has a groove 28 for receiving and nesting a resilient locking member (or pawl) 30. When the locking member (or pawl) 30 is placed into the groove 28, means 34 for fitting said locking member 30 in the groove 28, in the preffered embodiment of the present invention is a closure cap 34 which is laid over the top of the separator 24 for preventing the locking member 30 from slipping off. A pull tab 36 is loosely coupled to the locking member 30 via a ring 38 so that the slider body can be slided back and forth by means of pulling the pull tab 36.

Figure 2A:
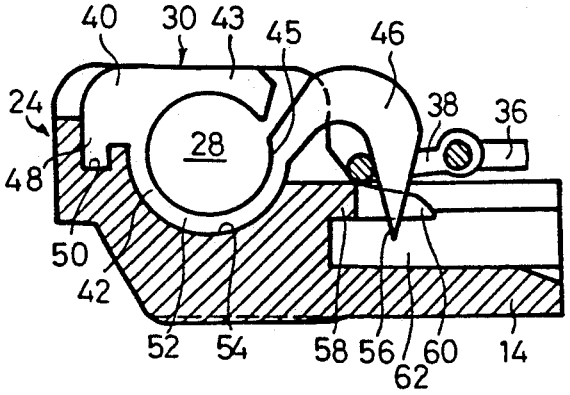
FIG. 2A is a schematic sectional view of the separator and resilient locking member of FIG. 1 in the locking position.
Figure 2B:
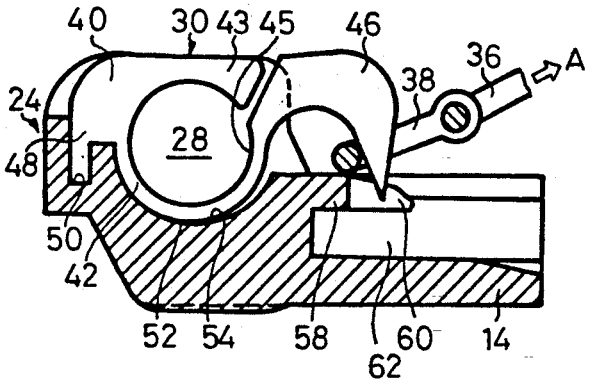
FIG. 2B is similar to FIG. 2A, but the resilient locking member thereof is located in the unlocking position.

Please refer to FIGS. 2A and 2B. The locking member 30 is integrally formed and includes a front insert section 40, a middle C-shaped section 42 having a first end 43 and a second end 45, and a tail hook section 46. The front insert section 40 is substantially C-shaped and has an insert projection 48 downwardly extending from the first end 43 of the C-shaped section. The groove 28 of the separator 24 is formed with a front insert recess 50 corresponding to the insert projection 48 of the front insert section 40 so that by means of the engagement between the projection 48 and the recess 50 and by means of the pressure exerted by the cap 34 on the first end 43 of the C-shaped section 42, the first end 43 thereof is restricted from rotating or moving or the like. In addition, the hook portion 46 has a locking hook 56 downwardly and rearwardly extending from the second end 45 through a hole 60 of a cantilever 58 of the separator 24 into a locking room 62 defined by the separator 24 and the bottom plate 14 of the slider body 14 whereby the locking hook 56 can automatically lock in an automatical locking position the rows of the fastener elements of the concealed zipper (not shown) which pass the locking room 62.

As shown in FIG. 2A, when the pull tab 36 is not forced by a user and located at a suspending position substantially parallel to the bottom plate 14, the locking member 30 does not suffer and upward force and the first and second ends of the C-shaped section 42 of the locking member 30 are kept away from each other, i.e., the second end 45 is located at a lower position with the locking hook 56 extending deep into the locking room 62. Accordingly, when the slider 10 of the instant invention is forced by the user, the slider is constantly in locked condition.

As shown in FIG. 2B, when the pull tab 36 is pulled by a user in direction A and is upwardly inclined, the locking member 30 suffers an upward force which raises the second end 45 of the C-shaped section 42 and makes the same closer to the fixed first end 43. At this time, the locking hook 56 is pulled out of the locking room 62 to unlock the fastener elements of the concealed zipper so that the slider body 12 can be smoothly pulled by the pull tab to uncoupled the concealed zipper.

Figure 3A:
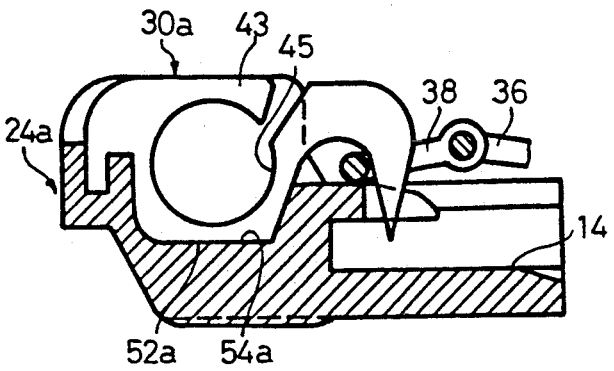
FIG. 3A is a schematic sectional view of the second embodiment of the separator and resilient locking member of FIG. 1 in the locking position.
Figure 3B:
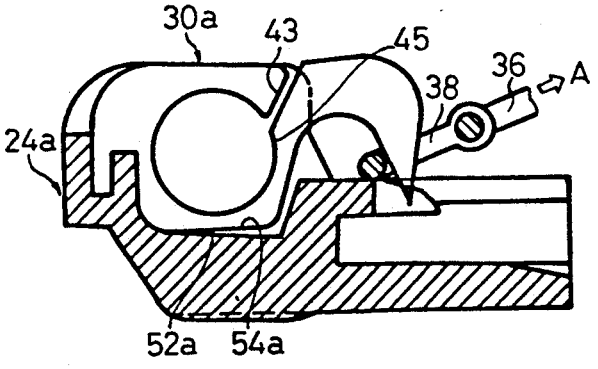
FIG. 3B is similar to FIG. 3A, but the resilient locking member thereof is located in the unlocking position.

FIGS. 3A and 3B show the second embodiment of the island separator **24*a* and the resilient locking member 30*a* which are structurally similar to those of FIGS. 2A and 2B. However, in FIGS. 2A and 2B, the contact surfaces 52 and 54 of the separator 24 and locking member 30 are arch surfaces while the contact surfaces 52*a* and 54*a* in FIGS. 3A and 3B are trapezoid surfaces. Both these two types of surfaces permit the first and second ends 43 and 45** to get closer to or away from each other via the resilience of the locking member.

Figure 4:
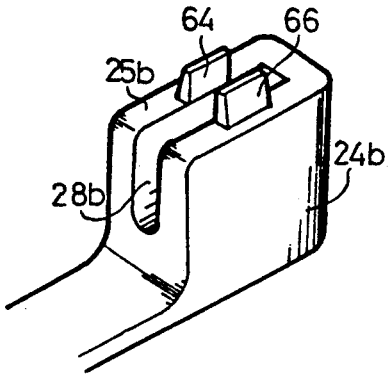
FIG. 4 is a partial perspective view of the third embodiment of the separator.

Please refer to FIG. 4. Alternatively, a pair of upwardly extending lateral projections 64 and 66 can be disposed on the top surface **25*b* of the separator 24*b* in symmetrical arrangement with respect to the longitudinal axis thereof. After the locking member 30 of FIGS. 1 is placed into the groove 28*b* of the separator 24*b*, the projections 64 and 66 are pressed into a horizontal state so as to abut against the top surface 47 of the resilient locking member 30 (referring to FIG. 1) and prevent the same from slipping off, the lateral projections 64 and 66 being one kinds of means for fitting the locking member 30 in the groove 28 can substitute for the cap 34 of FIG. 1. It should be noted that FIG. 4 shows a state of the lateral projections 64 and 66** before being pressed.

Figure 5:
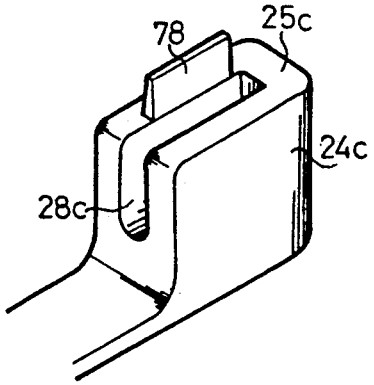
FIG. 5 is a partial perspective view of the fourth embodiment of the separator.

Please refer to FIG. 5. A single longer projection 78 can replace the two lateral projections 64 and 66. Similarly, after the locking member 30 is placed in the groove **28*c* of the separator 24*c*, the longer projection 78 is pressed into a horizontal state to abut against the top surface 47 of the locking member 30 so as to prevent the same from slipping off. FIG. 5 shows a state of the longer projection 78** before being pressed.

Figure 6:
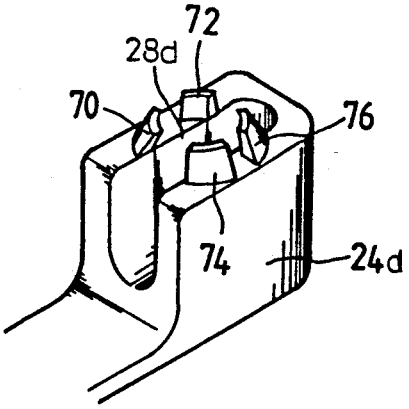
FIG. 6 is a partial perspective view of the fifth embodiment of the separator.

Please refer to FIG. 6. Alternatively, four projections 70, 72, 74 and 76 can be formed on the separator **24*d* in a substantially circular pattern and in a symmetrical arrangement with respect to the longitudinal axis thereof. These projections can be pressed into a horizontal state to abut against the top surface of the locking member. FIG. 6** shows a state of these projections before being pressed.

Figure 7:
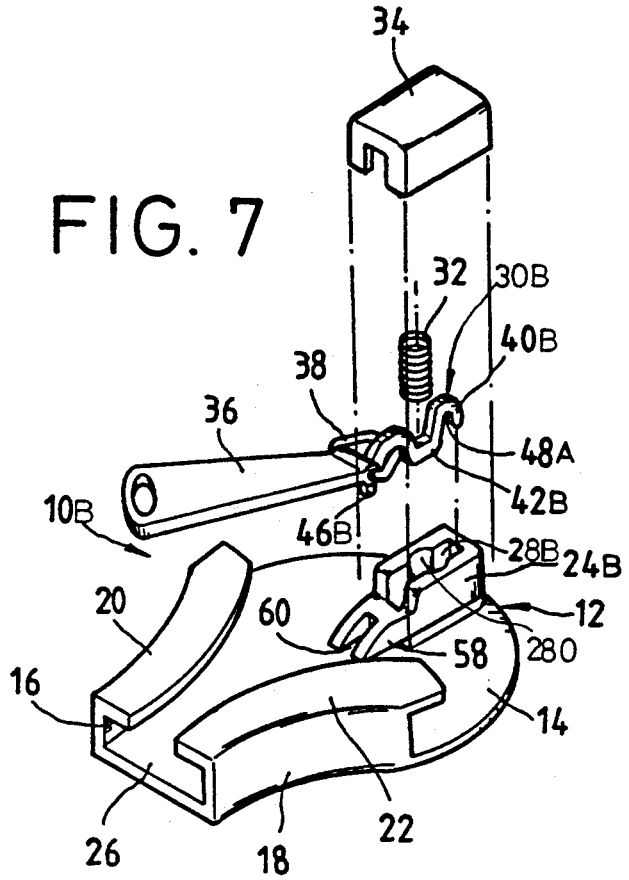
FIG. 7 is a perspective exploded view of the second embodiment of the slider of the present invention.
Figure 7A:
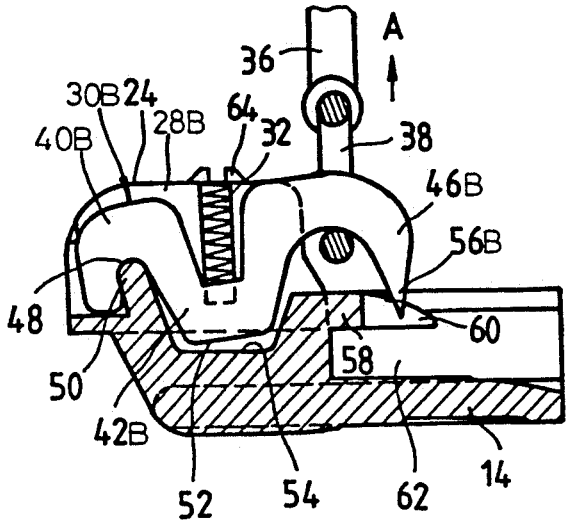
FIG. 7A is a schematic sctional view of the separator and resilient locking member of FIG. 7 in the unlocking position.

Please refer to FIGS. 7 and 7A which show a second embodiment of the slider 10A of the concealed zipper of the present invention, wherein the slider body 12, separator 24B, the Y-shaped guide groove 26, the pull tab 36 and the cap 34 are identical with those of the first embodiment 10 while the changes thereof reside in that a W-like resilient locking member 30B and a spring member 32 are substituted for the resilient locking member 30 shown in FIG. 1. Moreover, a chamber 280 for receiving the spring member 32 is disposed in the groove 28B in communication therewith. The resilient locking member 30B integrally includes a front pivot section 40B, a middle connecting section 42B and a tail hook section 46B. The upper surface of the middle connecting section 42B is pressed by the spring member 32 and the upper portion of the spring member 32 is further pressed by the closure cap 34 so that the locking member 30B is forced by the spring member 32.

Similar to the first embodiment, the locking member 30B can be controlled by the pull tab 36 and to an extent pivoted about the front pivot section 40B, permitting the tail hook section 46B to move back and forth between a normally automatic locking position and an unlocking position when the pull tab is pulled. Such effect is equivalent to that of the first embodiment.

Many changes, equivalent substitutions and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatically locking slider for a concealed zipper comprising:

a pull tab;

a slider body having a front end and a rear end;

a separator fixedly mounted at the center of the front end of said slider body, said separator being formed with a groove;

a substantially Y-shaped guide channel being defined by said slider body and said separator for guiding therethrough rows of fastener elements during the act of coupling or uncoupling the zipper;

said slider being characterized in that a resilient locking member is received and nested in said groove of said separator and means for fitting said resilient locking member in said groove is positioned on the top of said resilient member to allow pressure to be applied to said locking member to prevent it from slipping out of said groove;

whereby said locking member can be pivotally held in said groove, said pull tab being coupled to a rear end of said locking member via a ring so that said rear end can be controlled by said pull tab and moved back and forth between a locking position and an unlocking position when said pull tab is pulled; and wherein said locking member is integrally formed and includes a front insert section, a middle C-shaped section, and a tail hook section, said middle C-shaped section having a first end, a second end spaced therefrom and a surface corresponding to said groove of said slider body, permitting said first and second ends to move toward and away from each other, said front insert section having an insert projection downwardly extending from said first end, the groove of said separator being formed with a front insert recess corresponding to said insert projection, said hook portion having a locking hook rearwardly and downwardly extending from said second end for automatically locking rows of fastener elements of the concealed zipper, whereby via the relative movement between said first and second ends, said locking hook can move back and forth between an automatically locking position and an unlocking position.

2. A slider as claimed in claim 1, wherein said resilient locking member is integrally formed a W-like configuration including a front pivot section, a middle connecting section and a tail hook section, an upper surface of said middle connecting section being pressed by a spring member and an upper portion of said spring member being further pressed by said fitting means so that said locking member is forced by said spring member and located at a normally automatically locking position, whereby said locking member can be controlled by the pull tab and to an extent pivoted about the front pivot section, permitting said tail hook section to move back and forth between the normally automatic locking position and an unlocking position.

3. A slider as claimed in claim 1, wherein said corresponding surfaces of said C-shaped section of said resilient locking member and a bottom portion of said groove of said separator are curved surfaces.

4. A slider as claimed in claim 1, wherein said corresponding surfaces of said C-shaped section of said resilient locking member and a bottom portion of said groove of said separator are trapezoid surfaces.

* * * * *